US005353850A

United States Patent [19]

Ueda et al.

[11] Patent Number: 5,353,850

[45] Date of Patent: Oct. 11, 1994

[54] APPARATUS FOR DISTRIBUTEDLY FILLING PARTICULATE OR GRANULAR MATERIAL INTO CONTAINERS

[75] Inventors: Michio Ueda; Tetsuya Iuchi; Takao Miki; Hisanori Hamada, all of Tokushima, Japan

[73] Assignee: Shikoku Kakoki Co., Ltd., Tokushima, Japan

[21] Appl. No.: 133,256

[22] Filed: Oct. 8, 1993

[30] Foreign Application Priority Data

Oct. 8, 1992 [JP] Japan ..... 4-70227[U]

[51] Int. Cl.[5] ..... B65B 43/42

[52] U.S. Cl. ..... 141/129; 141/134; 141/144; 141/167; 141/174; 141/178; 141/237

[58] Field of Search ..... 141/129, 131, 136, 138, 141/163, 167, 178, 179, 183, 184, 185, 186, 234, 237, 238, 134, 144, 174

[56] References Cited

U.S. PATENT DOCUMENTS

| | | | |
|---|---|---|---|
| 3,433,181 | 3/1969 | Steins | 141/129 |
| 3,900,054 | 8/1975 | Hamer et al. | 141/129 |
| 4,315,532 | 2/1982 | Elsworth | 141/183 |
| 4,877,067 | 10/1989 | Shimokawa et al. | 141/129 |

*Primary Examiner*—Henry J. Recla
*Assistant Examiner*—Steven O. Douglas
*Attorney, Agent, or Firm*—Armstrong, Westerman, Hattori, McLeland & Naughton

[57] ABSTRACT

An apparatus for distributedly filling a particulate or granular material into containers has an intermittently driven container conveyor, and a continuously driven particulate or granular material conveyor extending across and positioned above the container conveyor. First chutes and second chutes are arranged between the container conveyor and material conveyor. The container conveyor comprises first holders and second holders arranged alternately in the direction of transport thereof and each adapted to hold containers C equal in number to the number of container transport paths, and is so driven as to feed one first holder to a first filling station and one second holder to a second filling station and stop the two fed holders at the respective stations at a time. A first particulate or granular material feeder and a second particulate or granular material feeder are arranged at opposite sides of the intersection of the two conveyors. The first chutes, as well as the second chutes, are equal in number to the number of container transport paths.

2 Claims, 4 Drawing Sheets

APPARATUS FOR DISTRIBUTEDLY FILLING PARTICULATE OR GRANULAR MATERIAL INTO CONTAINERS

BACKGROUND OF THE INVENTION

The present invention relates to an apparatus for distributedly filling, for example, particulate or granular materials which are ingredients of noodles into containers, i.e., cups, for preparing precooked noodles as contained in the cups.

U.S. Pat. No. 4,877,067 discloses an apparatus of the type mentioned which comprises an intermittently drivable container conveyor having a plurality of parallel container transport paths extending through a first filling station and a second filling station, a continuously drivable particulate or granular material conveyor having a first material transport path and a second material transport path extending across and positioned above the container transport paths at the first filling station and the second filling station respectively, first chutes arranged at the first filling station between the container transport paths and the first material transport path, and second chutes arranged at the second filling station between the container transport paths and the second material transport path. The container conveyor has holders successively arranged side by side in the direction of transport and each adapted to hold containers equal in number to the number of container transport paths. The container conveyor is so disposed and driven that the holders are successively stopped at the first filling station and the second filling station. One of the first and second material transport paths is provided with a particulate or granular material feeder. The plurality of container transport paths are divided into a first group of even-numbered paths as arranged from one side of the container conveyor and a second group of odd-numbers paths as arranged from that side of the conveyor. The first chutes are equal in number to the number of paths of the first group and have their lower-end openings disposed above the respective paths of the first group. The second shutes are equal in number to the number of paths of the second group and have their lower-end openings positioned above the respective paths of the second group. A particulate or granular material is fed separately to two groups of container transport paths at the first filling station and the second filling station, respectively, to distributedly fill containers.

When it is desired to double the filling capacity of the above apparatus, it appears feasible to double the distance the container conveyor is driven at a time with the intermittent feeding cycle time unchanged and to feed two holders at a time. The apparatus then needs to have two material conveyors, but this doubles the installation space and equipment cost.

SUMMARY OF THE INVENTION

An object of the present invention is to provide an apparatus for distributedly filling a particulate or granular material into containers which apparatus is given an increased filling capacity with minimized increases in the installation space and equipment cost.

The present invention provides an apparatus for distributedly filling a particulate or granular material into containers which apparatus comprises an intermittently drivable container conveyor having a plurality of parallel container transport paths extending through a first filling station and a second filling station, the container conveyor having first holders and second holders arranged alternately in the direction of transport and each adapted to hold containers C equal in number to the number of container transport paths, the container conveyor being operable to feed one first holder to the first filling station and one second holder to the second filling station and stop the two fed holders at the respective stations at a time; a continuously drivable particulate or granular material conveyor having a first material transport path and a second material transport path extending across and positioned above the container transport paths at the first filling station and the second filling station respectively; first chutes arranged at the first filling station between the first material transport path and the container transport paths and equal in number to the number of container transport paths and second chutes arranged at the second filling station between the second material transport path and the container transport paths and equal in number to the number of container transport paths; a first particulate or granular material feeder provided for the first material transport path and disposed upstream from the first filling station and a second particulate or granular material feeder provided for the second material transport path and disposed upstream from the second filling station; and means for transferring the particulate or granular material from the material conveyor to the container conveyor through the first chutes and the second chutes when the container conveyor is stopped.

With the apparatus of the present invention, the container conveyor has first holders and second holders arranged alternately in the direction of transport and each adapted to hold containers which are equal in number to the number of container transport paths. The container conveyor is so disposed and driven as to feed one first holder to the first filling station and one second holder to the second filling station and stop the two fed holders at the respective stations at a time. The first material feeder is provided upstream from the first filling station along the first material transport path, and the second material feeder is disposed upstream from the second filling station along the second material transport path. The first chutes, as well as the second chutes, are equal in number to the number of container transport paths. Accordingly, the particulate or granular material is delivered from the material conveyor and distributedly filled into the containers held by the first holder through the first chutes at the first filling station, and is delivered from the material conveyor and similarly filled into the containers held by the second holder through the second chutes at the second filling station.

With the present invention, therefore, the apparatus can be given an increased filling capacity merely by doubling the distance the container conveyor is to be driven at a time for feeding and employing an additional material feeder without the need to install two particulate or granular material conveyor and with minimized increases in the installation space and equipment cost.

DESCRIPTION OF THE PREFERRED EMBODIMENT

An embodiment of the invention will be described below with reference to the drawings.

In the following description, the term "front" refers to the direction in which containers advance as transported by a conveyor (downward direction in FIG. 1), the term "rear" to the direction opposite to the above, and the terms "right" and "left" are used as the apparatus is viewed from the front rearward.

Figure 1:
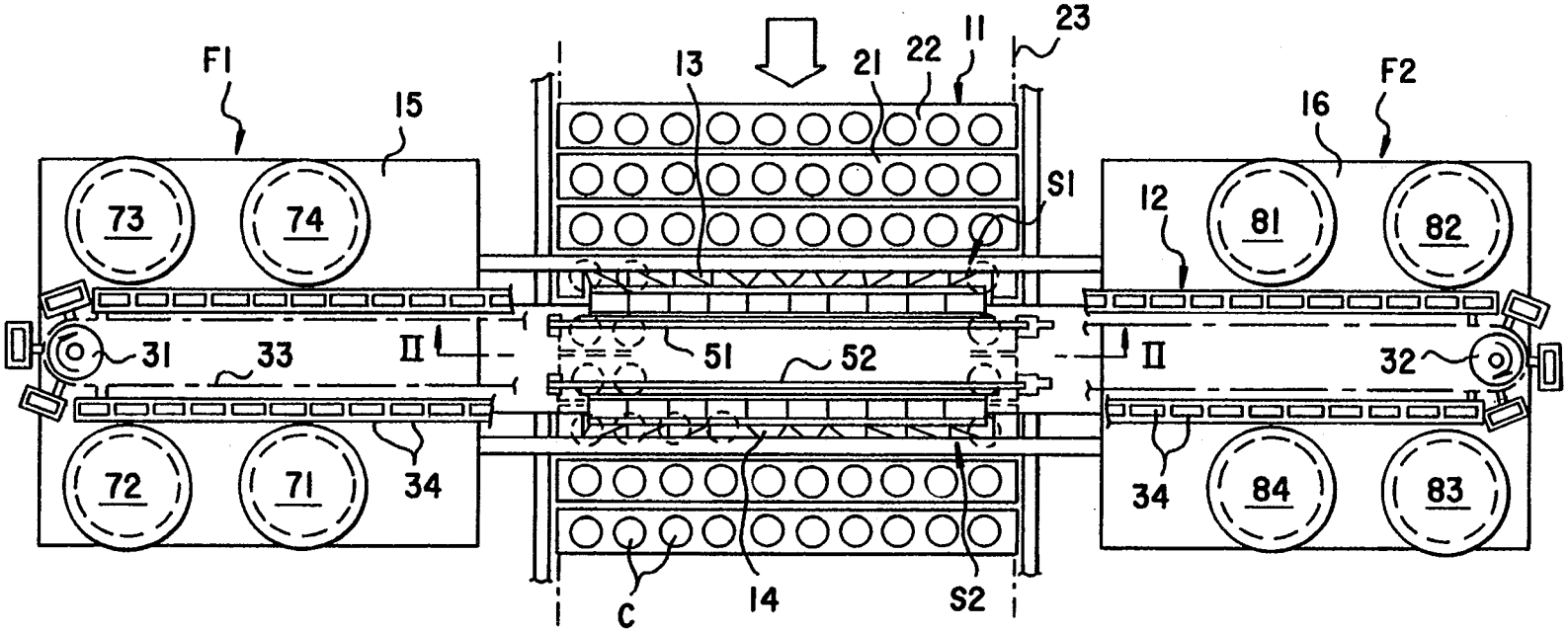
FIG. 1 is a plan view of an apparatus of the invention.

With reference to FIG. 1, a first filling station S1 and a second filling station S2 are provided as spaced apart by a predetermined distance along the direction of transport of containers. At the left and right sides of the two stations S1, S2, a first material feed station F1 and a second material feed station F2 are provided respectively.

The illustrated apparatus is adapted to distributedly fill a particulate or granular material into containers and comprises an intermittently drivable container conveyor 11 having ten container transport paths extending through the first filling station S1 and the second filling station S2, a continuously drivable particulate or granular material conveyor 12 having a first material transport path and a second material transport path extending across and positioned above the container transport paths at the first filling station S1 and the second filling station S2, respectively, and extending by way of the first and second material feed stations F1, F2, ten first chutes 13 arranged at the first filling station S1 between the first material transport path and the container transport paths, ten second chutes 14 arranged at the second filling station S2 between the second material transport path and the container transport paths, and first and second particulate or granular material feeding devices 15 provided at the first and second material feed stations F1, F2, respectively.

The container conveyor 11 comprises a multiplicity of first holders 21 and second holders 22 each in the form of a slat and arranged alternately in the direction of transport of containers, a pair of right and left endless chains 23 carrying the holders 21, 22 attached thereto, and means (not shown) for driving the chains 23 so as to transport the first and second holers 21, 22 intermittently a specified distance at a time. The first and second holders 21, 22 are formed with ten apertures 24 and ten apertures 25, respectively, for holding cuplike containers C therein.

Figure 3:
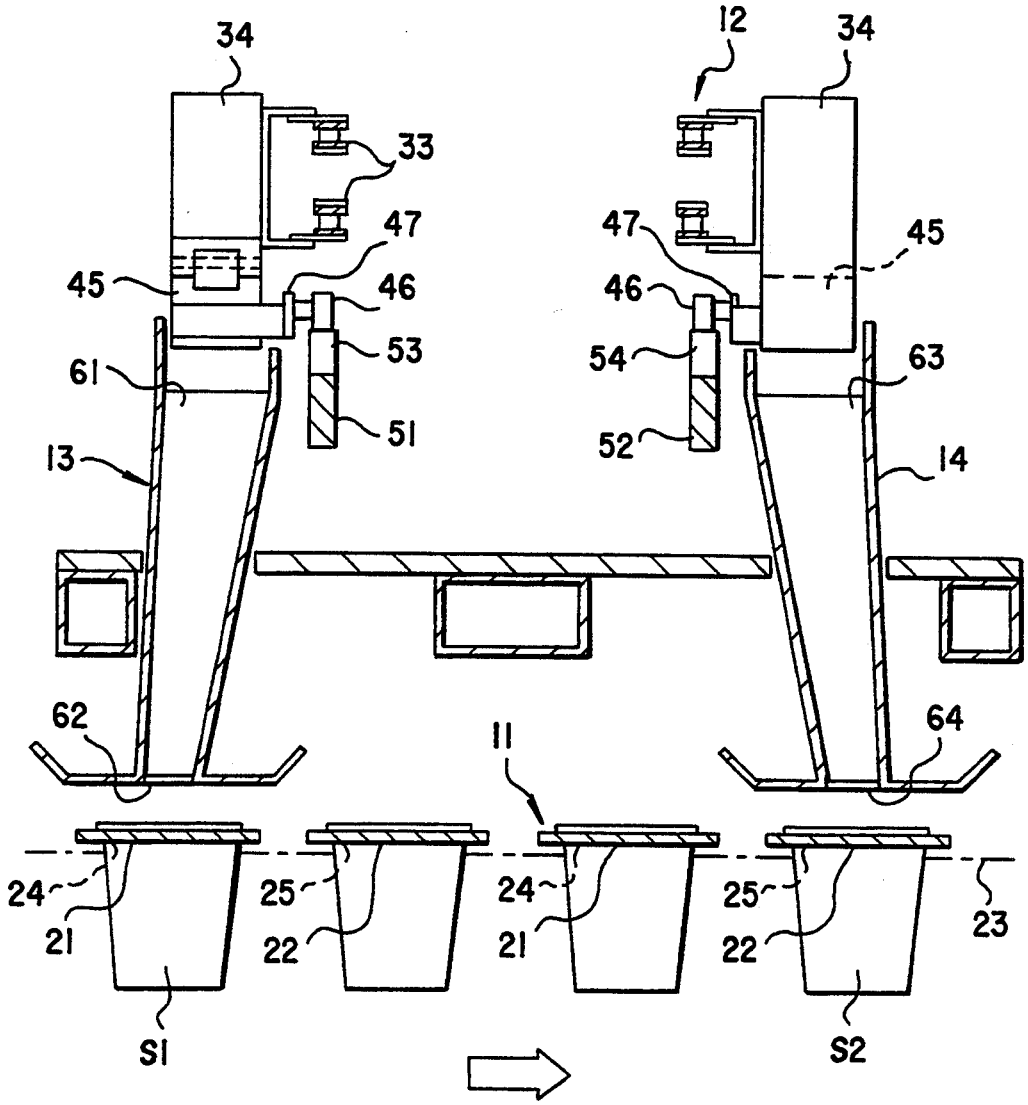
FIG. 3 is a view in section taken along the line III—III in FIG. 2.

With reference to FIG. 3, the distance between the first and second filling stations S1, S2 corresponds to three holder pitches. Every time the conveyor 11 is driven the specified distance, one first holder 21 is fed to the first station S1 and one second holder 22 to the second station S2.

The particulate or granular material conveyor 12 comprises driven sprockets 31 disposed at the first material feed station F1, drive sprockets 32 disposed at the second material feed station F2, a pair of upper and lower horizontal endless chains 33 reeved around these sprockets 31, 32, and a multiplicity of buckets 34 attached to the chains 33 at a spacing slightly smaller than the distance between the container transport paths in an outwardly projecting manner.

With reference to FIG. 1, the drive sprockets 32 are rotatingly driven clockwise, and the driven sprockets 31 are rotated also in the same direction.

Figure 4:
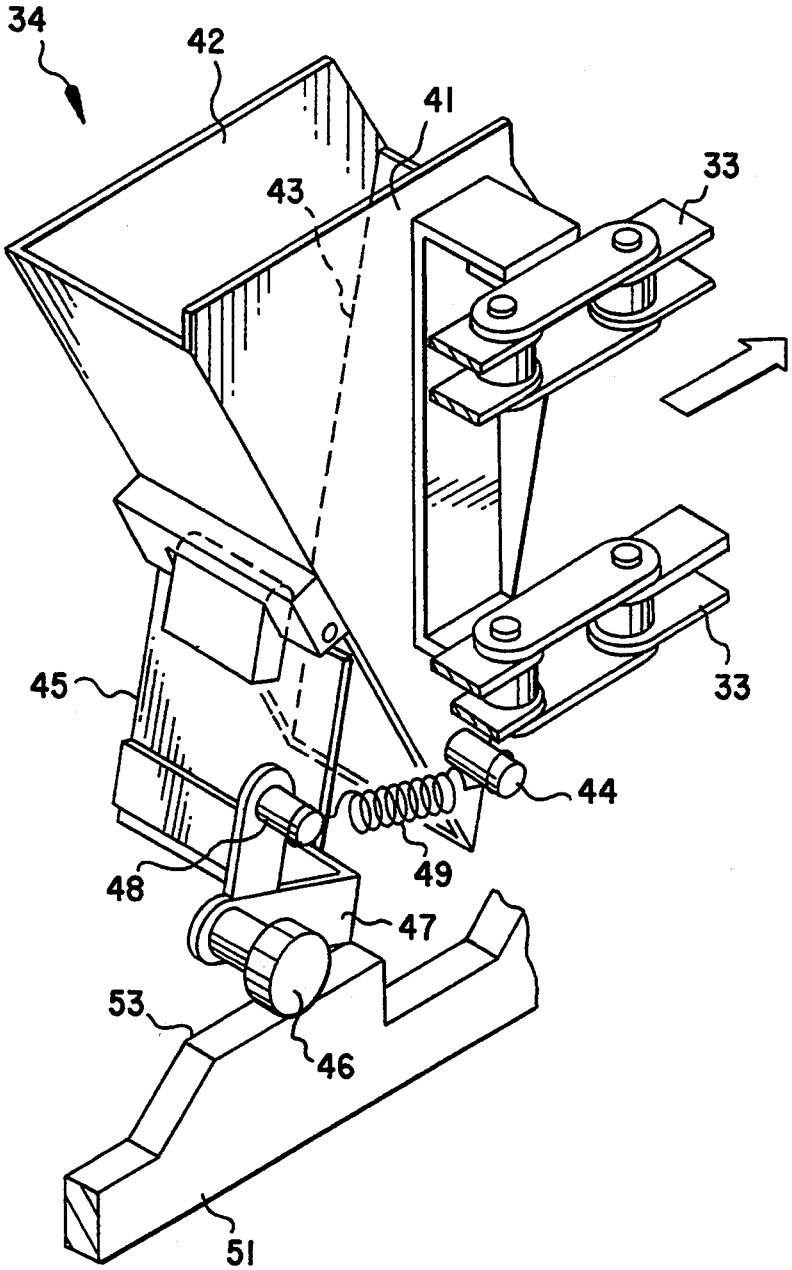
FIG. 4 is a perspective view of a bucket and parts provided in the vicinity thereof.

As shown in detail in FIG. 4, the bucket 34 comprises inner and outer side walls 41, 42 opposed to each other and generally in an inverted triangular form, and a bottom wall 43 V-shaped in section and interconnecting lower edges of the side walls 41, 42. A spring pin 44 is provided on the outer side of the inner side wall 41. The bottom wall 43 has an openable bottom closure 45 at its lower end portion. The bottom closure 45 has an opening arm 47 carrying a contact roller 46 at a projecting end thereof. The arm 47 is provided at an intermediate portion thereof with a spring pin 48, which has engaged therewith one end of a tension spring 49. The other end of the spring 49 is in engagement with the spring pin 44, whereby the bottom closure 45 is always biased in a closing direction.

A first lift rail 51 extends along the first material transport path, and a second lift rail 52 along the second material transport path. The first and second lift rails 51, 52 have 10 upward cam projections 53 and 10 upward cam projections 54, respectively.

Figure 2:
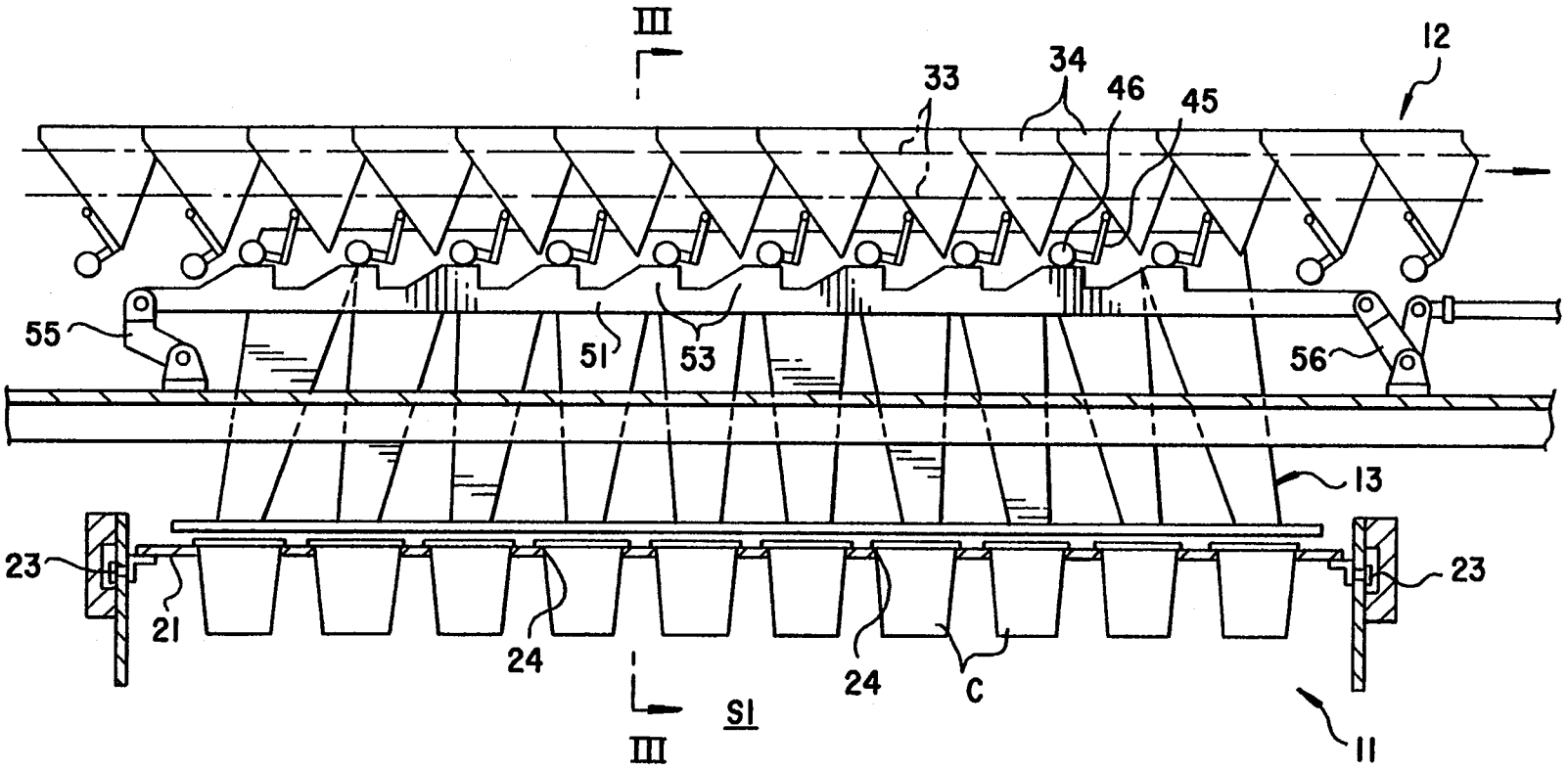
FIG. 2 is a view in section taken along the line II—II in FIG. 1.

With reference to FIG. 2, opposite ends of the first lift rail 51 are supported by left and right pivotal arms 55, 56. The first lift rail 51 is moved upward and downward by the right pivotal arm 56 which is pivotally moved by suitable means. Although not shown, the second lift rail 52 is also moved upward and downward by like means.

With reference to FIG. 3, the first chute 13 is in the form of a tube having an upper end providing an inlet 61 and a lower end providing an outlet 62, and is so positioned that the outlet 62 is opposed from above to a container C as stopped at the first filling station S1. Like the first chute 13, the second chute 14 is in the form of a tube having an upper end providing an inlet 63 and a lower end providing an outlet 64, and is so positioned that the outlet 64 is opposed from above to a container C as stopped at the second filling station S2. As shown in FIG. 2, the inlets 61 of the first chutes 13 are larger than the outlets 62 thereof, but the pitch of the inlets 61 is smaller than the pitch of the outlets 63. This is also true of the second chutes 14.

The first material feeding device 15 comprises four kinds of feeders 71 to 74 successively arranged along the direction of movement of the buckets. The second material feeding device 16 also comprises four kinds of feeders 81 to 84.

The material conveyor 12 is driven in sychronism with the container conveyor 11 such that every time the container conveyor 11 is driven the specified distance, one bucket 34 moves past the inlets 61 or 63 of ten first chutes 13 or second chutes 14.

When the first holder 21 is stopped at the first filling station S1 with the second holder 22 stopped at the second filling station S2, the first and second lift rails 51, 52 are raised at the same time, and the contact rollers 46 of the buckets 34 traveling above the inlets 61, 63 of the first and second chutes 13, 14 ride on the corresponding cam projections 53, 54, whereby the bottom closures 34 are opened. Before each of these buckets 34 completely moves past the chute 13 (14) thereabove, the particulate or granular material within the bucket 34 is placed into the chute 13 (14). The material placed in falls through the chute 13 (14) and is delivered from the outlet 62 (64) of the chute to fill the container C waiting therebelow. The contact roller 46 thereafter moves over the cam projection 53 (54). This closes the bottom closure 45 of the emptied bucket 34. The material is fed to the empty bucket 34 in preparation for the subsequent filling operation when the bucket moves past the first or second material feeding device 15 or 16.

When the material has been filled into the containers C stopped at the first and second filling stations S1, S2, the container conveyor 11 is driven the specified distance to deliver the filled containers C from the stations S1, S2, and empty containers C to be filled in the next cycle are fed to the first and second filling stations S1, S2. Before the containers C thus fed to the stations S1, S2 are brought to a halt, the buckets 34 containing the material to be delivered in the subsequent cycle are so moved as to be positioned above the respective first and second chutes 13, 14 in preparation for the next filling cycle.

What is claimed is:

1. An apparatus for distributedly filling a particulate or granular material into containers comprising:

an intermittently drivable container conveyor having a plurality of parallel container transport paths extending through a first filling station and a second filling station, the container conveyor having first holders and second holders arranged alternately in the direction of transport and each adapted to hold containers C equal in number to the number of container transport paths, the container conveyor being operable to feed one first holder to the first filling station and one second holder to the second filling station and simultaneously stop the two fed holders at the respective stations at a time, a continuously drivable particulate or granular material conveyor having a first material transport path and a second material transport path extending across and positioned above the container transport paths at the first filling station and the second filling station respectively, first chutes arranged at the first filling station between the first material transport path and the container transport paths and equal in number to the number of container transport paths and second chutes arranged at the second filling station between the second material transport path and the container transport paths and equal in number to the number of container transport paths, a first particulate or granular material feeder provided for the first material transport path and disposed upstream from the first filling station and a second particulate or granular material feeder provided for the second material transport path and disposed upstream from the second filling station, and means for transferring the particulate or granular material from the material conveyor to the container conveyor through the first chutes and the second chutes when the container conveyor is stopped.

2. An apparatus as defined in claim 1 wherein each of the first chutes and the second chutes has an upper end providing an inlet and a lower end providing an outlet, and the pitch of the inlets of the first chutes and the second chutes is smaller than the pitch of the outlets thereof.

* * * * *